United States Patent [19]

Brown

[11] 4,384,439

[45] May 24, 1983

[54] TUCK AND NEST METHOD AND APPARATUS

[75] Inventor: Gaylord Brown, Punta Gorda, Fla.

[73] Assignee: Sweetheart Plastic, Inc., Wilmington, Mass.

[21] Appl. No.: 217,754

[22] Filed: Dec. 18, 1980

[51] Int. Cl.[3] ..... B65B 35/50; B65B 7/04

[52] U.S. Cl. ..... 53/378; 53/540; 414/30; 414/105; 414/107; 414/108

[58] Field of Search ..... 53/540, 378, 447, 443; 414/30, 46, 69, 70, 105, 107, 108

[56] References Cited

U.S. PATENT DOCUMENTS

| | | | |
|---|---|---|---|
| 2,416,381 | 2/1947 | Conti | 414/105 |
| 2,725,992 | 12/1955 | Wells | 414/105 |
| 3,351,388 | 11/1967 | Frank | 414/105 X |
| 3,497,086 | 2/1970 | Adams et al. | 414/105 |
| 3,773,457 | 11/1973 | Badoux et al. | 414/105 X |
| 4,066,174 | 1/1978 | Collins et al. | 414/105 X |

*Primary Examiner*—Horace M. Culver
*Attorney, Agent, or Firm*—John J. Swartz

[57] ABSTRACT

Method and apparatus for stacking a plurality of plastic cups disposed within individual plastic envelopes including a frame, a conveyor on the frame, a stuffer swingably movable on the frame to stuff a portion of the envelope into the cup and move it into nested relation with the next adjacent downstream one of the cups to form a stack.

4 Claims, 3 Drawing Figures

TUCK AND NEST METHOD AND APPARATUS

BACKGROUND OF THE INVENTION

1. Field of the Invention

This invention relates to apparatus for and a method of stacking containers which are disposed within individual plastic envelopes and more particularly to an apparatus for and a method of tucking portions of the envelopes into the containers and nesting the containers to form a stack.

2. Description of the Prior Art

Hotels, motels, and the like frequently use plastic, disposable cups which, for sanitation, are encompassed within a thin, transparent, plastic film bag. To minimize shipping costs and conserve space, portions of the bags have been manually inserted into the cups which heretofore have been manually nested with similarly configured cups. The bags or envelopes have small holes therein to permit air trapped within the bag or envelope to escape when the bags or envelopes are stuffed into the cups. Such manual stuffing is time consuming and expensive.

Accordingly, it is an object of the present invention to provide apparatus for and a method of stuffing a portion of the plastic envelope into the container disposed within the envelope and nesting the stuffed container with a similarly stuffed container to form a stack.

The holes which are provided in the plastic envelopes or bags are relatively small and thus some time is required to permit the escape of air which is trapped within the envelopes or bags. If the envelope or bag is compressed too rapidly, the bag or envelope may burst. Accordingly, it is an object of the present invention to provide tucking and nesting apparatus which will gradually compact the nested stuffed containers.

It is a further object of the present invention to provide tuck and nest apparatus which will form a stack of nested containers and include mechanism for releasably interrupting the downstream movement of a downstream portion of the stack such that, as successive cups are stuffed and added to the stack to move the upstream stack portion toward the downstream stack portion, each cup in the stack will gradually move more closely towards the next succeeding downstream cup and the spacing between each pair of nested cups in the stack will be less than the spacing between the next adjacent pair of containers upstream thereof.

Still another object of the present invention is to provide stacking apparatus of the type described which includes a container conveyor, apparatus for tucking a portion of the envelopes into the containers and then nesting the containers to form a stack, and aligning mechanism for successively aligning the closed downstream ends of bagged containers to be stacked with the open upstream end of the upstream container in the stack.

Other objects and advantages of the present invention will become apparent to those of ordinary skill in the art as the description thereof proceeds.

SUMMARY OF THE INVENTION

Apparatus for stacking a plurality of hollow containers, each open at one end and closed at the opposite end, disposed within individual plastic bags having end portions projecting rearwardly outwardly beyond the rearward open ends of the containers disposed therein; the apparatus comprising: mechanism for successively receiving and conveying, in a downstream path of travel, a plurality of the bagged containers; and mechanism for successively stuffing the end portion of each bag into the open end of the container disposed therein and nesting the stuffed container with the next adjacent downstream one of the stuffed containers to form a stack of stuffed, nested containers. The invention contemplates a method of tucking the plastic bag into the container and nesting the containers to form a stack.

BRIEF DESCRIPTION OF THE DRAWINGS

The present invention may more readily be understood in reference to the accompanying drawing in which.

DESCRIPTION OF THE PREFERRED EMBODIMENT

Figure 1:
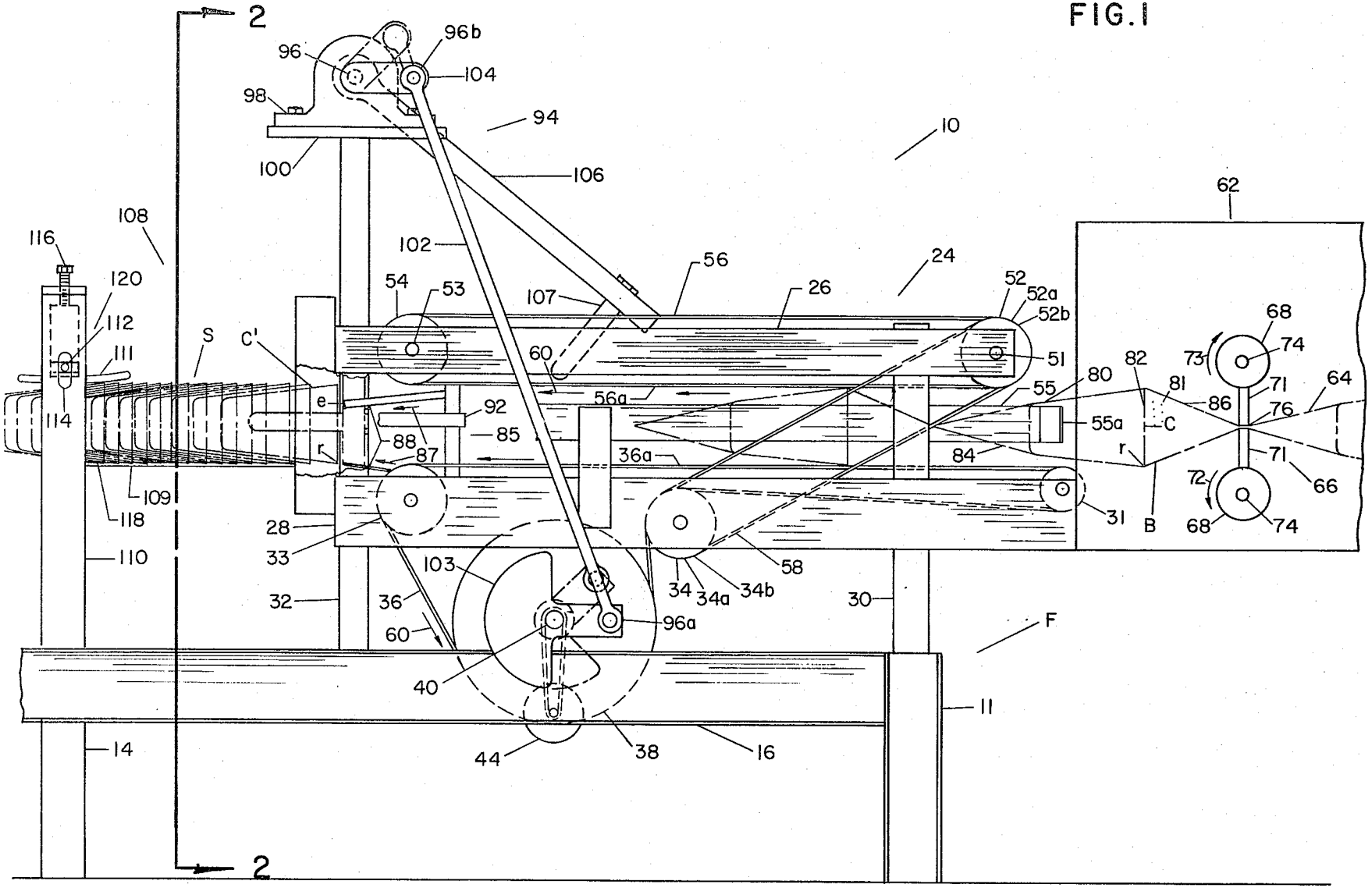
FIG. 1 is a side elevational view of apparatus constructed according to the present invention.

Apparatus constructed according to the present invention, generally designated 10, includes a frame, generally designated F, having, a pair of laterally spaced apart, upstanding forward legs 11 and a pair of laterally spaced upstanding rearward legs 14 spanned by laterally spaced, longitudinal side channel members 16. Longitudinally spaced transverse cross beams 18, 20 and 22 span the side frame members 16.

Figure 2:
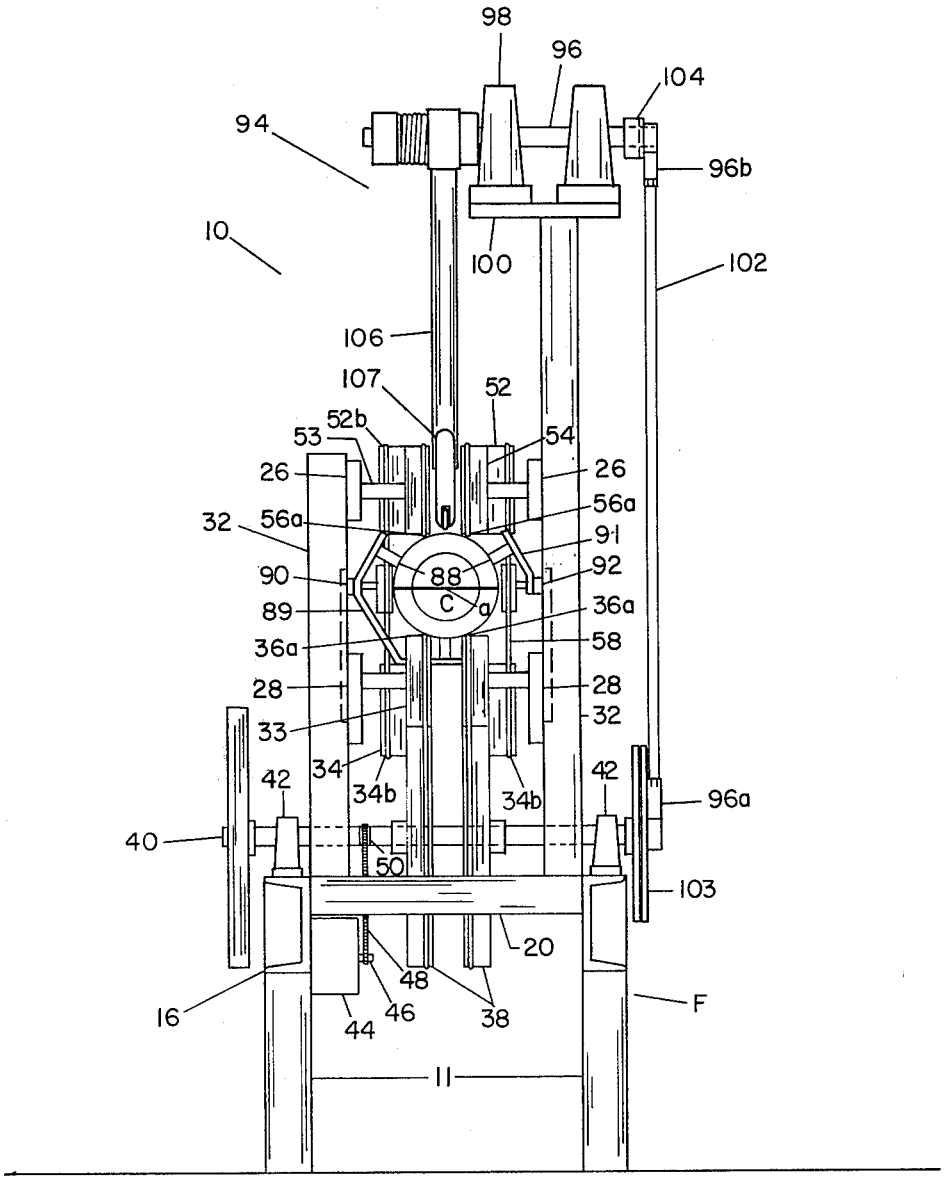
FIG. 2 is a sectional end view, taken along the line 2—2 of FIG. 1.
Figure 3:
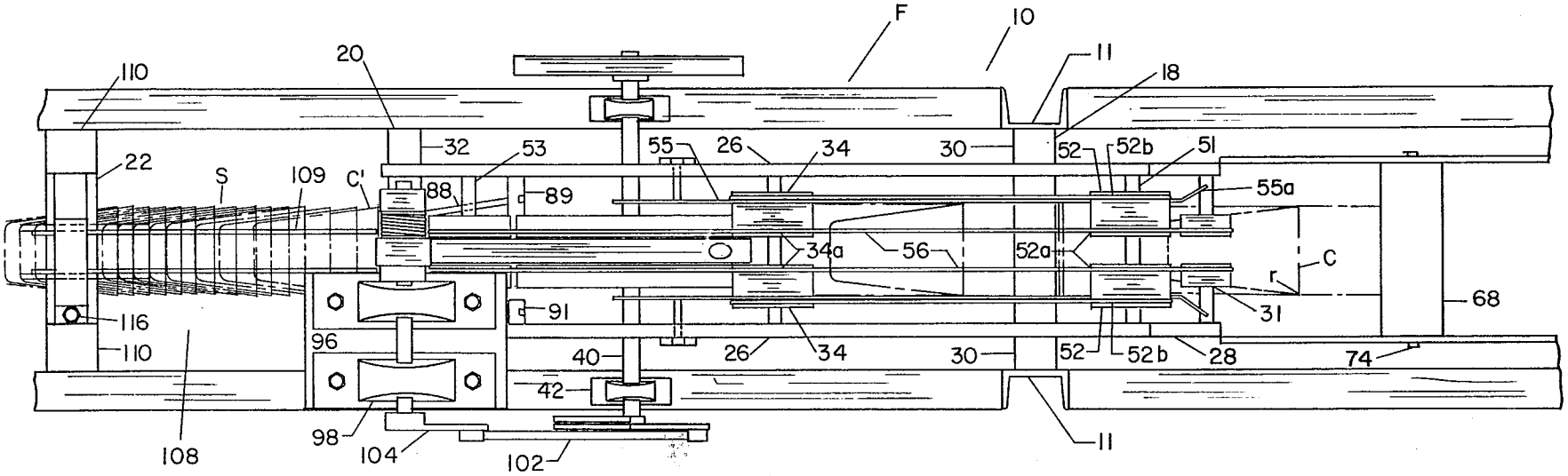
FIG. 3 is a top plan view thereof.

Mounted atop the forward end of the frame F is a conveyor, generally designated 24, including upper and lower laterally spaced pairs of side rails 26 and 28, respectively, mounted on front and rear pairs of laterally spaced upstanding posts 30 and 32 which are mounted on the transverse cross beams 18 and 20. As illustrated in FIG. 2, one of the posts 32 is substantially longer than the other post 32. Journalled for rotation on each of the laterally spaced lower rails 28 is a forward, single groove pulley 31, a rearward single groove pulley 33, and an intermediate double groove pulley 34 having a pair of annular grooves **34*a* and 34*b*. A pair of laterally spaced, endless, continuous belts 36 is trained around pulleys 31, 33, 34 as well as a pair of enlarged, diameter single groove pulleys 38 keyed to a drive shaft 40 which is journalled on frame supported bearings 42 mounted on the side frame members 16. The belts 36, which may suitably comprise polyurethane material, are received in grooves 34*a* provided in the pulleys 34**.

The shaft 40 may be suitably driven by an endless chain 48 trained around a sprocket wheel 50 fixed to the shaft 40 and a sprocket wheel 46 driven by a frame supported electric motor 44 (FIG. 2).

Journalled on shafts 51 and 53, mounted on each of the upper set of laterally spaced rails 26, is a double groove forward pulley 52, each having a pair of annular grooves **52*a* and 52*b* therein, and a single groove rearward pulley 54. A pair of laterally spaced apart, endless belts 56 is trained around the pulleys 54 and the grooves 52*a* provided in the pulleys 52. The belts 56 are driven by a pair of coupling belts 58 trained around the second grooves 52*b* of pulleys 52 and the grooves 34*b* of pulleys 34. The driving relation is such that the inner runs 36*a* and 56*a* of the belts 36 and 56, respectively, will move in the direction of the arrows 60. The pulleys 31, 33, 52, and 54 are vertically adjustable by suitably mounting structure (not shown) to vertically adjust the container drive belts 36 and 56 and accomodate containers of varying diameters. Mounted on the frame F interjacent the rails 26 and 28 is a pair of side rail guide fences 55 having outwardly flared ends 55***a*.

The conveyor 24 is disposed adjacent a heat sealing and bagging machine, generally designated 62, of the type manufactured by Tevopharm or FMC Corporation. The bagging machine 62 disposes a plurality of hollow, longitudinally spaced tapered cups C, having closed ends 80 and enlarged diameter open ends 82 into a continuous hollow transparent flexible plastic film envelope 64 having a plurality of small openings 81 therein for a purpose to become apparent hereafter. The bag making machine 62 includes a pair of vertically spaced sealing and trimming devices 68 at a seal and trim station, generally designated 66. The sealing and trimming devices include heat seal blades 71 mounted via shafts 74, for rotating movement in the directions of the arrows 72 and 73 to periodically clamp opposite sides of longitudinally spaced film portions 76, of the envelope 64, intermediate the cups C. The blades 71 heat seal the portions 76 together and cut the envelope 64 to provide individual bags B for each of the containers or cups C.

The film bags B formed at the seal and trim station 66 include end portions 84 and 86 which project beyond the ends 80 and 82 respectively, of the cups C disposed therein.

The bagging machine 62 discharges the bagged containers to the conveyor 24 which receives the bagged containers and transfers them, closed end first downstream in the direction of the arrow 60 via the confronting belt runs 36*a* and 56*a* of the belts 36 and 56. The inner runs 36*a* and 56*a* of the belts 36 and 56 are circumferentially spaced so as to tangentially grip circumferentially spaced portions of the rims r of the bagged containers.

The conveyor 24 moves the bagged cups downstream in the direction of the arrows 60 to a cup guide, generally designated 85. The cup guide 85 includes three circumferentially spaced apart spring steel, yieldable fingers 88 which converge in the downstream direction of arrow 87. Two of the fingers 88 are mounted on a mounting bracket 89 supported on one of the side rails 32 via a mounting bar 90. The remaining finger 88 is mounted on a slightly smaller bracket 91 mounted on the opposite support rail 32 via a mounting bar 92. The mounting bars 90 and 92 may be slotted to permit longitudinal adjustment of the fingers 88. The terminal ends of the fingers 88 are disposed in the path of a portion of the bagged cups, to axially align the cups as they move in the downstream path of travel. The fingers 88 have an axial length approximately equal to the axial length of containers C.

Container stuffing mechanism, generally designated 94, is provided and includes a rock shaft 96 journalled in bearings 98 mounted on a frame supported platform 100 which is fixed to the upper end of the longer one of the two upstanding side posts 32.

The rock shaft 96 is rocked in a to-and-fro path of travel, via an eccentric drive arm 102 pivotally coupled at one end 96*a* to a crank arm 103, fixed to the drive shaft 40 and, at its opposite end, 96*b* coupled to a drive arm 104 which is fixed to one end of the rock shaft 96.

A plunger mounting arm 106 is fixed to the rock shaft 96 for swinging movement therewith between a raised inoperative position, illustrated in solid lines in FIG. 1, and a container stuffing and nesting position illustrated in chain lines in FIG. 1. Mounted at the terminal end of the plunger mounting arm 106 is an elongate plunger 107 which, when the arm 106 moves to the position illustrated in chain lines in FIG. 1, tucks the upstream portion 86 of the plastic film bag B into the open end 82 of the container C disposed within the bag B. As the plunger 107 swings through an arc of approximately 50°–60° moves from the inoperative position illustrated in solid lines to the stuffing position illustrated in chain lines, the cup C which is guided by the guide fingers 88, is moved downstream. The cup C is moved downstream onto a receiver assembly, generally designated 108, for nesting with similarly stuffed containers C. The operation of the plunger 107 is timed such that the plunger 107 will drive the stuffed container downstream when it is released by the conveyor belts 36 and 56.

The receiver assembly 108 includes a pair of laterally spaced longitudinally extending stack support bars 109 spanning the frame member 32 and a pair of frame supported upstanding support members 110. As the containers C, having an axis a, are moved by plunger 107 onto the support bars 109, they will be nested with similar containers to form a stack S. The receiver assembly 108 includes a vertically adjustable holddown bar 111 mounted on the upstanding frame members 110 via guides 112 received in slots 114 provided in the frame members 110. A threaded screw 116 is utilized to vertically adjust the position of guides 112 and the holddown bar 111. The holddown bar 111 will grip or bear against a downstream portion 118 of the stack S of nested stuffed containers C at a compression station 120 to releasably inhibit downward movement of the downstream portion 118 of the stack S.

When the stuffer 107 is fully advanced to the stuffing position illustrated in chain lines (FIG. 1) the container rim r will be just slightly (i.e. ¼–½ inch) downstream of the terminals ends e of the guide fingers 88.

THE OPERATION

In operation, cups C, disposed within sealed individual plastic envelopes or bags B are successively received by the conveyor 24, closed end first, and moved downstream in the direction of the arrow 60. It will be assumed that a stack S of stuffed nested containers C are disposed on the receiver 108 as illustrated in FIG. 1. As the container C moves downstream with the conveyor belts 36 and 56 the container C will be received by the cup guide 85 to align the downstream reduced diameter container end 80 with the open end 82 of the next adjacent downstream one of the container C′ in the stack S. The plunger 107 is operated in timed relation with the supply of bagged containers so that the plunger 107 advance to the bagging position illustrated in chain lines in FIG. 1 to move the container C upon its discharge by the conveyor 24. The fingers 88 guide the containers as the plunger 107 moves it into nesting relation with the next adjacent downstream one of the containers C′ in the stack S. The plunger 107 thus will tuck the upstream portion 86 of the envelope B into the hollow containers C and nest the container C with the upstream endmost one of the container C in the stack S.

When the bag end 86 is initially moved into the cup C, a portion of the air trapped within the plastic envelope or bag B will escape outwardly through holes 81 provided in the bag B. When the container C is initially moved into the stack S, it is not fully nested with the next adjacent downstream container C. As successive cups are added to the stack, the stuffed container C will move slightly closer to the next downstream container C so that the containers C become progressively further nested as they continue downstream movement. As subsequent containers or cups are stuffed and nested, each cup or container C will gradually move closer toward the downstream adjacent cup. After the containers C reach the hold down bar 111 or the compression zone 120, the stacked nested containers remain substantially equally spaced. For example, the container C after initial stuffing is approximately 1 inch further away from the next succeeding downstream container C' than it is when it reaches holddown bar 111.

The plunger 107 will thus serve to tuck the envelope end 86 into the hollow container C but also will nest the containers C and incrementally index the stack S. Because retarding force is exerted on the downstream container 118 by holddown bar 111, as the plunger 107 adds a container to the stack S and incrementally indexes the stack, the containers C will progressively move closer to the adjacent downstream container in the stack. This will permit remaining air in the bag to be progressively forced out of the bag B without tearing the bag B. The spacing between each pair of adjacent containers in the stack upstream of holddown bar 111 will be progressively less than the spacing between each successive pair of adjacent containers upsteam thereof. After the containers C reach the holddown bar the spacing between the containers in the stack S will remain substantially constant. The hold down device 111 will permit the stack S thus formed to move downstream where the stack can be separated into selected lengths for shipment.

If desired, a counter can be mounted onto the frame for counting the number of containers in the stack.

It is to be understood that the drawings and descriptive matters are in all cases to be interpreted as merely illustrative of the principles of the invention, rather than as limiting the same in any way, since it is contemplated that various changes may be departing from the spirit of the invention or the scope of the appended claims.

What I claim is:

1. Apparatus for stacking a plurality of hollow containers, each open at one end and closed at the opposite end and being disposed within an individual plastic bag, said apparatus comprising:

means for successively receiving and conveying, in a downstream path of travel, a plurality of said containers each disposed within a plastic bag having an end portion projecting rearwardly outwardly beyond the open end of the container disposed therein; and means for stuffing an end portion of each bag into the open end of the container disposed therein and nesting the stuffed container downstream with the next succeeding downstream one of said stuffed containers to form a stack of stuffed, nested containers;

said conveying means comprising a plurality of generally parallel endless belts for moving said containers;

said stuffing and nesting means comprising a stuffer swingably mounted for movement in a to-and-fro path between a removed position and a position disposed between said belts at least partially received by said open end of said container being stuffed and nested.

2. The apparatus set forth in claim 1 including aligning means for aligning the closed end of each container with the open end of the next succeeding downstream end of said containers.

3. Apparatus for stacking containers having reduced diameter closed ends and an enlarged diameter open ends, said containers being disposed within a plastic envelope having ends projecting rearwardly of the trailing ends of the containers disposed therein, said apparatus comprising:

a frame;

means for successively conveying said containers and said envelopes to a stacking station;

a stuffer mounted on said frame at said stacking station for movement in a to-and-fro swinging path of travel;

means for swinging said stuffer in a to-and-fro path of travel between a removed position and a stuffing position received by the open end of each container to move said forward portion of said envelope into the open end of said container and to move the closed end of said container into the open end of the next adjacent downstream container to form a stack of containers; and means mounting said stuffer for movement between said removed position and a position disposed between said belts.

4. The apparatus set forth in claim 3 wherein said stuffer comprises a mounting arm swingably mounted on said frame and an elongate stuffer rod projecting therefrom for receipt by the open end of said container.

* * * * *